US006116712A

United States Patent [19]

Laharty et al.

[11] Patent Number: 6,116,712

[45] Date of Patent: Sep. 12, 2000

[54] METHOD AND APPARATUS FOR COMPENSATING FOR THERMAL CONDITIONING IN AN INK JET PRINT HEAD

[75] Inventors: Christopher J. Laharty, Wilsonville; Michele L. Fingerson, Albany; Richard Schmachtenberg, III, Aloha, all of Oreg.

[73] Assignee: Xerox Corporation, Stamford, Conn.

[21] Appl. No.: 09/170,851

[22] Filed: Oct. 13, 1998

[51] Int. Cl.[7] ..... B41J 29/38

[52] U.S. Cl. ..... 347/14; 347/20; 347/40; 347/195

[58] Field of Search ..... 347/14, 17, 20, 347/40, 48, 54, 194, 195, 58, 9

[56] References Cited

U.S. PATENT DOCUMENTS

| | | | |
|---|---|---|---|
| 5,389,958 | 2/1995 | Bui et al. | 347/103 |
| 5,422,664 | 6/1995 | Stephany | 347/14 |
| 5,483,265 | 1/1996 | Kneezel | 347/14 |
| 5,502,469 | 3/1996 | Watanabe | 347/14 |
| 5,635,964 | 6/1997 | Burr et al. | 347/17 |
| 5,677,718 | 10/1997 | Crawford et al. | 347/92 |
| 5,689,291 | 11/1997 | Tence et al. | 347/10 |

OTHER PUBLICATIONS

U.S. Patent Application, Apparatus and Method For Drop Size Modulated Ink Jet Printing, SN 09/124,636, Filed Jul. 29, 1998, 28 pages.

HP 2000C: The New Emperor of Desktop Color Technology, Cover Story From the Apr. 1998 Issue of The Hard Copy Supplies Journal, Lyra Research Inc, 10 pg.

*Primary Examiner*—John Barlow
*Assistant Examiner*—Cesar Lago
*Attorney, Agent, or Firm*—Charles F. Moore

[57] ABSTRACT

A method and apparatus for automatically compensating for thermal conditioning of an ink jet print head are provided. The method and apparatus monitor the time during which the print head experiences various temperatures. The driving voltage supplied to the ink jet transducer is adjusted over time to compensate for thermal conditioning of the print head.

18 Claims, 3 Drawing Sheets

FIG. 3
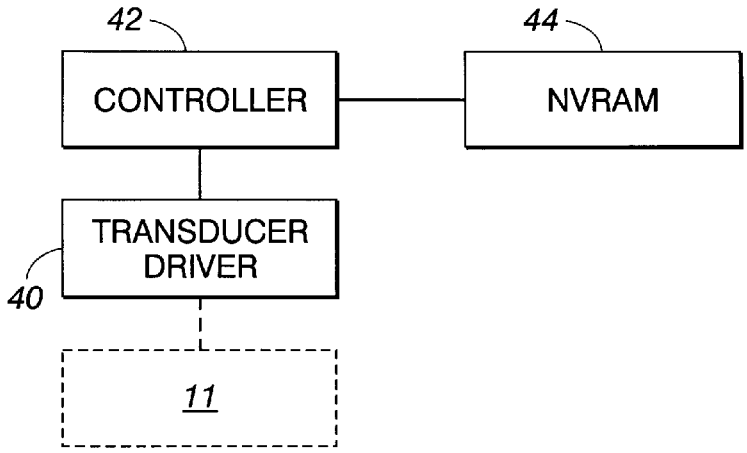
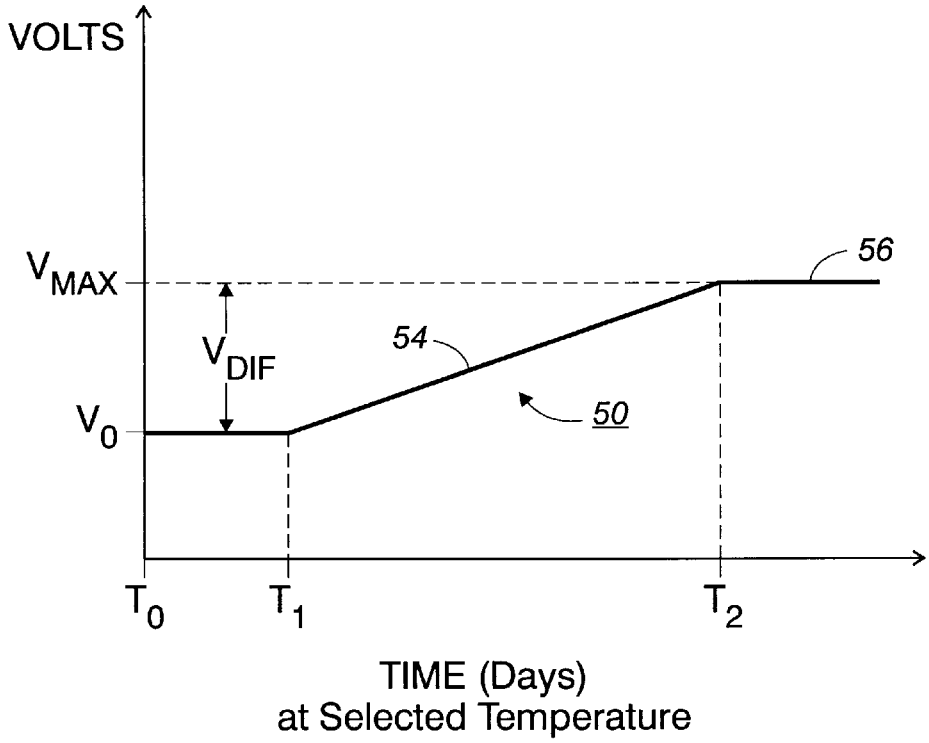
FIG. 4

METHOD AND APPARATUS FOR COMPENSATING FOR THERMAL CONDITIONING IN AN INK JET PRINT HEAD

FIELD OF INVENTION

This invention relates generally to a method and apparatus for compensating for thermal conditioning in an ink jet print head and, more specifically, to a method and apparatus that automatically adjusts the voltage supplied to an ink jet transducer to compensate for thermal conditioning over time.

BACKGROUND OF THE INVENTION

A typical color ink jet print head includes an array of ink jets that are closely spaced from one another for use in ejecting drops of ink toward a receiving surface. The typical print head also has at least four manifolds for receiving black, cyan, magenta and yellow ink for use in monochrome plus subtractive color printing. The number of such manifolds may be varied where a printer is designed to print solely in black ink, gray scale or with less than a full range of color.

In a conventional ink jet print head, each ink jet is paired with an electro mechanical transducer, such as a piezoelectric transducer (PZT). The transducer typically has metal film layers to which an electronic transducer driver is electrically connected. When a voltage is applied across the metal film layers of the transducer, the transducer attempts to change its dimensions. Because it is rigidly attached to a flexible diaphragm, the transducer bends and deforms the diaphragm, thereby causing the outward flow of ink through the ink jet.

Prolonged use of a PZT-driven ink jet print head at elevated temperatures can alter print head performance. This change in performance can result in image degradation due to the performance variations. For example, the drop mass of ejected ink drops can vary as the print head components are thermally conditioned over time. The positioning of the ejected ink drops on the receiving surface can also vary with thermal conditioning.

It is known to manually adjust the voltage applied to a PZT-driven ink jet to offset variations in ink drop mass. However, this manual voltage adjustment typically cannot be performed by an end-user, and requires a service professional to travel to the end-user site to perform the adjustment. This process is time-consuming and relatively expensive for the user. Additionally, for practical and economical reasons this manual adjustment procedure is performed only periodically. This reduces the effectiveness of the adjustment procedure in maintaining a consistent ink drop mass.

The present invention provides a method and apparatus for automatically compensating for thermal conditioning of an ink jet print head. Thermal conditioning of the print head is monitored and the voltage supplied to the ink jet transducer is adjusted over time to maintain a more consistent ink drop mass.

SUMMARY OF THE INVENTION

It is an aspect of the present invention to provide a method and apparatus for dynamically adjusting for thermal conditioning of a print head without requiring user input.

It is a feature of the present invention that the method and apparatus are capable of adjusting for thermal conditioning at multiple temperatures.

It is another feature of the present invention that the method and apparatus calculate and monitor a thermal aging period of the print head.

It is yet another feature of the present invention that the method and apparatus store thermal aging information in a non-volatile memory source.

It is still another feature of the present invention that the method and apparatus tracks time at a selected temperature and converts time at other temperatures to time at the selected temperature.

Still other aspects of the present invention will become apparent to those skilled in this art from the following description, wherein there is shown and described a preferred embodiment of this invention by way of illustration of one of the modes best suited to carry out the invention. The invention is capable of other different embodiments and its details are capable of modifications in various, obvious aspects all without departing from the invention. Accordingly, the drawings and descriptions will be regarded as illustrative in nature and not as restrictive. And now for a brief description of the drawings.

BRIEF DESCRIPTION OF THE DRAWINGS

FIG. 3 is a schematic diagram showing the printer controller controlling a transducer driver that supplies voltage to the PZT in the ink jet, and the controller in communication with an NVRAM memory source.

FIG. 4 is a graph of a voltage compensation curve with the Y-axis indicating the voltage supplied to the transducer and the X-axis indicating the thermal aging period of the print head expressed in time (DAYS) at a selected temperature.

Reference will now be made in detail to the present preferred embodiment of the invention, an example of which is illustrated in the accompanying drawings.

DETAILED DESCRIPTION OF THE PREFERRED EMBODIMENT

Figure 1:
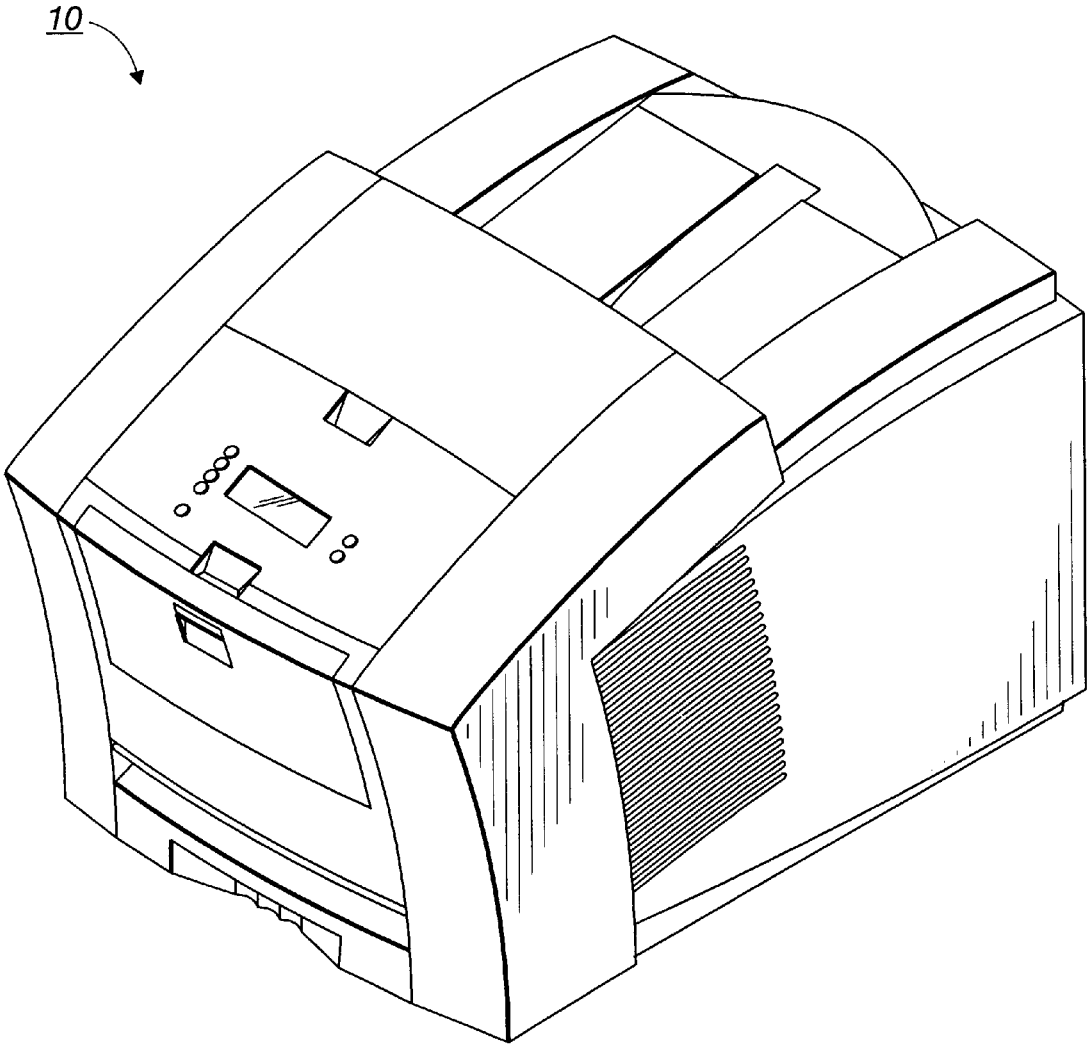
FIG. 1 is an overall perspective view of an ink jet printer that uses the method and apparatus of the present invention.

FIG. 1 is an overall perspective view of a phase change ink jet printing apparatus, generally indicated by the reference numeral 10, that utilizes the method and apparatus of the present invention. It will be appreciated that the present invention may be practiced with and embodied in various other imaging apparatus that utilize an ink jet print head, such as aqueous ink jet printers and the like. Accordingly, the following description will be regarded as merely illustrative of one embodiment of the present invention.

Figure 2:
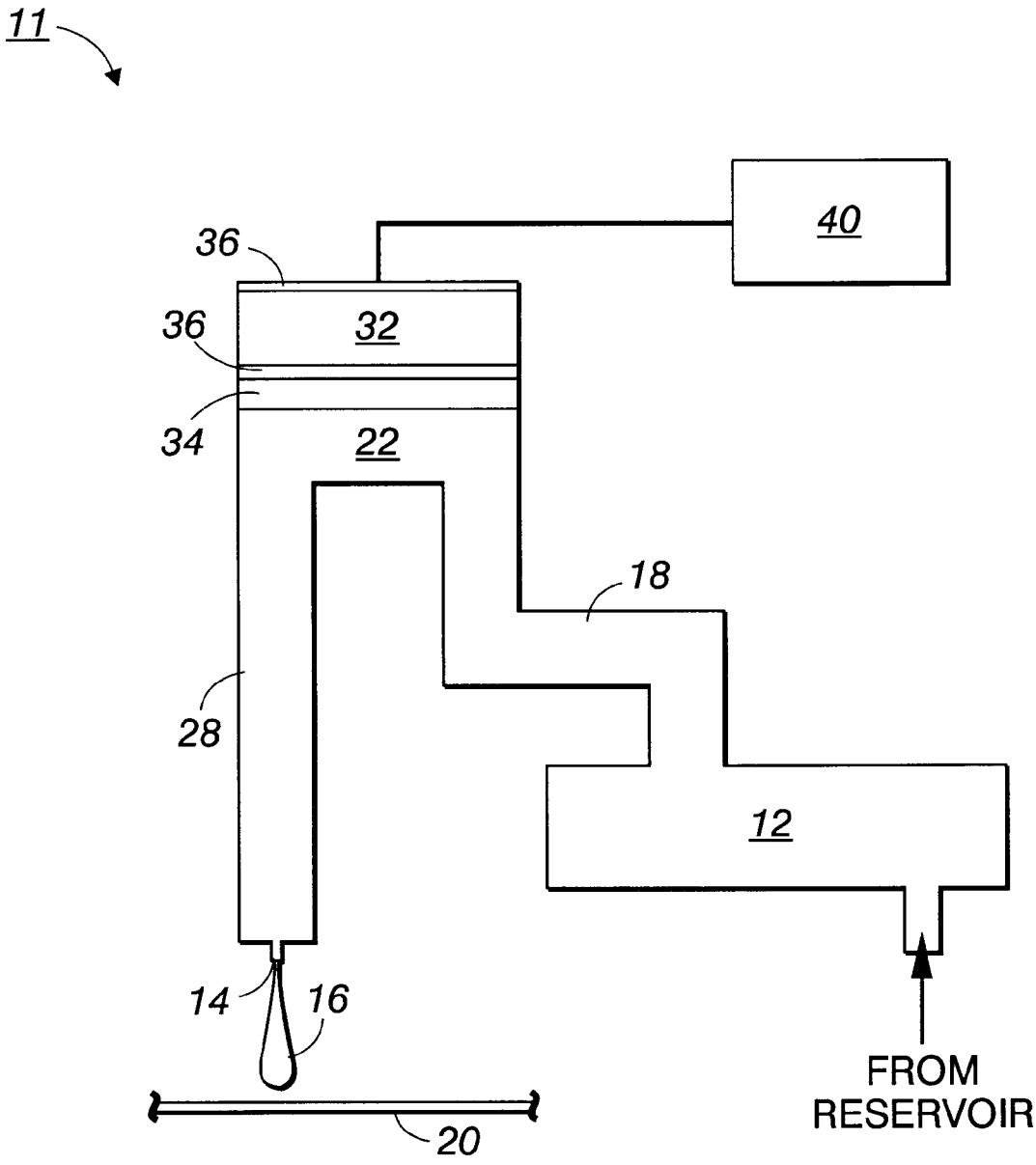
FIG. 2 is an enlarged schematic view of a preferred PZT driven ink jet suitable for use with this invention.

FIG. 2 shows a schematic view of an individual ink jet 11 according to the present invention. It will be appreciated that the ink jet 11 is a part of a multiple-orifice ink jet print head contained in the printer 10. Ink jet 11 includes an ink manifold 12 that receives molten or liquid ink from a reservoir (not shown). Ink flows from manifold 12 through an inlet channel 18 into an ink pressure chamber 22. Ink flows from the pressure chamber 22 into an outlet channel 28 to the ink drop forming orifice 14, from which an ink drop 16 is ejected toward a receiving surface 20.

The ink pressure chamber 22 is bounded on one side by a flexible diaphragm 34. An electro mechanical transducer 32, such as a piezoelectric transducer (PZT), is secured to diaphragm 34 by an appropriate adhesive and overlays ink pressure chamber 22. The transducer mechanism 32 can comprise a ceramic transducer bonded with epoxy to the diaphragm plate 34, with the transducer centered over the ink pressure chamber 22. The transducer may be substantially rectangular in shape, or alternatively, may be substantially circular or disc-shaped. In a conventional manner, transducer 32 has metal film layers 36, such as gold or nickel layers, to which an electronic transducer driver 40 is electrically connected.

The transducer 32 described with the preferred embodiment is a bending-mode transducer. Transducer 32 is operated in its bending mode such that when a voltage is applied across metal film layers 36, transducer 32 attempts to change its dimensions. Because it is securely and rigidly attached to diaphragm 34, transducer 32 bends and deforms diaphragm 34, thereby displacing ink in ink pressure chamber 22 and causing the outward flow of ink through outlet channel 28 to nozzle 14. Refill of ink pressure chamber 22 following the ejection of an ink drop is accomplished by reverse bending of transducer 32 and the resulting movement of diaphragm 34. It will be appreciated that other types and forms of transducers may also be used, such as shear-mode, annular constrictive, electrostrictive, electromagnetic or magnetostrictive transducers.

Ink jet 11 may be formed from multiple laminated plates or sheets, such as sheets of stainless steel, that are stacked in a superimposed relationship. An example of a multiple-plate ink jet is disclosed in U.S. Pat. No. 5,689,291 entitled METHOD AND APPARATUS FOR PRODUCING DOT SIZE MODULATED INK JET PRINTING, and assigned to the assignee of the present application. U.S. Pat. No. 5,689,291 is specifically incorporated by reference in pertinent part. It will be appreciated that various numbers and combinations of plates may be utilized to form the ink jet 11 and its individual components and features. Persons skilled in the art will also recognize that other modifications and additional features may be utilized with this type of ink jet to achieve a desired level of performance and/or reliability. For example, acoustic filters may be incorporated into the ink jet to dampen extraneous and potentially harmful pressure waves. The positioning of the manifolds, pressure chambers and inlet and outlet channels in the print head may also be modified to control ink jet performance.

The ink jet 11 is preferably designed to operate with phase change ink. Conventional phase change ink is solid at room temperature and becomes a flowing liquid at its jetting temperature of between about 120° C. and about 140° C. When the ink jet printer 10 is in a printing or ready condition, the print head is maintained at the required jetting temperature for the phase change ink being used. The printer 10 may also enter other status conditions in which the print head is maintained at a lower temperature than the jetting temperature. For example, the printer may enter a printer standby condition after a predetermined is amount of time has elapsed without a print command or other operation. In one embodiment of the printer standby condition, the print head is maintained at a temperature of between about 100° C. and about 120° C., and preferably at about 110° C.

The printer 10 may also utilize a jetstack standby condition in which the print head is maintained at a temperature closer to but still lower than the required jetting temperature. For example, after a first predetermined amount of time without a print command or other operation, the printer may initially enter the jetstack standby condition corresponding to a print head temperature of between about 113° C. and about 143° C., and preferably at about 128° C. In another embodiment of the jetstack standby condition, the print head reservoir temperature may be held within this range, while the temperature of the ink jet 11 is lowered to the preferred printer standby temperature of 110° C. After a second predetermined amount of time in the jetstack standby condition, such as one hour, the temperatures of the print head reservoir and ink jet 11, if necessary, are lowered to the printer standby condition temperature of approximately 110° C.

With reference now to FIGS. 3 and 4, a preferred embodiment of the method and apparatus of the present invention will now be described. As illustrated in FIG. 3, a controller 42 in the printer 10 controls the operation of the transducer driver 40. In an important aspect of the present invention, the controller 42 also monitors the print head in its various operating and standby conditions to track a total time during which the print head experiences a plurality of temperatures. As mentioned above, prolonged use of a PZT-driven ink jet print head at elevated temperatures can alter the performance of the transducer and/or other ink jet components. For example, thermal conditioning of the ink jet over time can cause variations in the drop mass of the ejected ink drops. The positioning of the ejected ink drops on the receiving surface can also vary with thermal aging.

To reduce ink drop mass variations and drop positioning errors due to thermal conditioning, and in an important aspect of the present invention, the controller 42 monitors and calculates a thermal aging period of the print head. When the thermal aging period reaches a first predetermined value, the controller 42 alters the voltage supplied to the transducer 32 by the transducer driver 40 to compensate for drop mass variations due to thermal conditioning.

In one embodiment, the thermal aging period is defined as the period of time during which the print head experiences at least a selected temperature. In this embodiment, the controller 42 monitors the time that the print head is in an operating or printing mode, corresponding to a selected temperature of between about 120° C. and about 140° C., and preferably about 135° C. With reference now to FIG. 4, the accumulated time that the print head experiences at least the selected temperature is plotted on a voltage compensation curve 50. The time or thermal aging period along the horizontal axis is measured in calendar days/24 hour periods (DAYS) during which the print head experiences at least the selected temperature. The vertical axis defines the voltage supplied to the transducer 32. At time $T_0$ the transducer 32 initially receives a voltage waveform with a peak voltage corresponding to $V_0$. The peak voltage remains constant at $V_0$ until the time at the selected temperature (thermal aging period) equals a first value $T_1$. Preferably, $T_1$ is about 140 calendar days. It will be appreciated that the value of $T_1$ may be varied to suit the performance characteristics of a particular print head or to achieve a desired drop mass consistency.

When the thermal aging period reaches $T_1$, the controller 42 begins increasing the voltage supplied to the transducer 32 as the thermal aging period increases. In the preferred embodiment, the voltage is increased at a linear rate indicated by the sloping portion 54 of the curve 50. Preferably, the voltage is increased at a rate or slope of between about 0.001 Volts/DAY and about 0.015 Volts/DAY, and more preferably at about 0.008 Volts/DAY, where DAY=$D_{PT}$, and $D_{PT}$ is defined as calendar days during which the print head experiences at least the selected temperature. This linear increase in voltage from the initial $V_0$ value continues as the thermal aging period increases until a maximum differential voltage $V_{DIF}$ has been added to the initial Voltage $V_0$. In a preferred embodiment, the maximum differential voltage $V_{DIF}$ is between about 2.0 Volts and about 4.0 Volts. With reference to the horizontal portion 56 of the curve 50, after the maximum differential Voltage $V_{DIF}$ has been reached at time $T_2$, the voltage remains constant at a value $V_{MAX}$ as the thermal aging period continues.

In another embodiment of the present invention, the controller 42 also monitors the time that the print head experiences other temperatures, such as when the print head is in the printer standby or jetstack standby condition. In this embodiment the thermal aging period is defined as a period of time during which the print head experiences the selected temperature, the printer standby temperature or the jetstack standby temperature. As explained above, the printer enters the printer standby condition after a predetermined amount of time has passed without a print command being received by the printer or other action that requires operation of the print head. In the jetstack standby mode, the print head is maintained at a temperature higher than the printer standby temperature, but still less than the operating temperature, for a defined period of time before entering the printer standby condition.

To account for the thermal conditioning experienced by the print head during the printer standby and jetstack standby conditions, the controller 42 converts the time at these lower standby temperatures to time at the selected or operating temperature. To accomplish this conversion, the controller multiplies the time in each standby mode by a scaling factor. In the preferred embodiment, the time in the printer standby mode $D_{PS}$ is expressed in calendar days during which the print head experiences the printer standby temperature. This time is converted to $D_{PT}$ calendar days at the selected temperature by multiplying it by a printer standby scaling factor $F_{PS}$. Similarly, the time in the jetstack standby mode $D_{JS}$ is expressed in calendar days during which the print head experiences the jetstack standby temperature. This value is converted to $D_{PT}$ calendar days at the selected temperature by multiplying $D_{JS}$ by a jetstack standby scale factor $F_{JS}$. Preferably, both scaling factors $F_{PS}$ and $F_{JS}$ have a value of about 0.145. With reference again to FIG. 4 and utilizing these scaling factors, the value in DAYS of a coordinate along the horizontal axis may be expressed as $DAY=D_{PT}+[(D_{PS})*(F_{PS})]+[(D_{JS})*(F_{JS})]$.

With reference now to FIG. 3, a non-volatile memory source 44 (NVRAM) is used to store the thermal aging period information corresponding to the amounts of time during which the print head is in the various modes of operation and standby. This thermal aging period information is updated whenever the printer changes status conditions, such as when a print command is received or when the printer enters one of the standby modes. In the preferred embodiment, the thermal aging period information in the NVRAM 44 is also updated at least every five minutes when the status condition of the printer has not changed.

In an additional embodiment of the present invention, multiple operating or printing modes may be utilized for ejecting different drop masses. The voltage compensation curve 50 may then be adjusted for each mode to optimize the voltage compensation for each mode. For example, the printer 10 may utilize first, second and third printing modes that eject ink drops having three different drop masses. For each of the three printing modes, the selected temperature remains at about 135° C. and the time $T_1$ is about 140 DAYS. For the first printing mode, a maximum differential voltage $V_{DIF}$ is about 3.0 Volts and the slope of the sloping portion 54 of the voltage compensation curve 50 is about 0.008 Volts/DAY. For the second and third printing modes, a maximum differential voltage $V_{DIF}$ is about 2.5 Volts and the slope of the sloping portion 54 of the curve 50 is about 0.007 Volts/DAY.

An ink jet printer according to the present invention includes a print head having multiple ink jets 11 as described above. Examples of an ink jet print head and an ink jet printer architecture are disclosed in U.S. Pat. No. 5,677,718 entitled DROP-ON-DEMAND INK JET PRINT HEAD HAVING IMPROVED PURGING PERFORMANCE and U.S. Pat. No. 5,389,958 entitled IMAGING PROCESS, both patents assigned to the assignee of the present application. U.S. Pat. Nos. 5,677,718 and 5,389,958 are specifically incorporated by reference in pertinent part. It will be appreciated that other ink jet print head constructions and ink jet printer architectures may be utilized in practicing the present invention. The method and apparatus of the present invention may also be practiced to jet various fluid types including, but not limited to, aqueous and phase-change inks of various colors.

The foregoing description of a preferred embodiment of the invention has been presented for purposes of illustration and description. It is not intended to be exhaustive or to limit the invention to the precise form disclosed. The terms and expressions which have been employed in the foregoing specification are used therein as terms of description and not of limitation. The use of such terms and expressions is not intended to exclude equivalents of the features shown and described or portions thereof. Many changes, modifications, and variations in the materials and arrangement of parts can be made, and the invention may be utilized with various different printing apparatus, other than solid ink offset printer, all without departing from the inventive concepts disclosed herein.

The preferred embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when the claims are interpreted in accordance with breadth to which they are fairly, legally, and equitably entitled. All patents cited herein are incorporated by reference in their entirety.

What is claimed is:

1. A method of compensating for drop mass variation over time in an ink jet print head, the ink jet print head including an ink jet that utilizes a transducer to eject an ink drop having a drop mass, the transducer being actuated to eject the ink drop by receiving a voltage, the method comprising the steps of:

tracking a total time during which the print head experiences a plurality of temperatures;

calculating a thermal aging period for the print head, wherein the thermal aging period is defined to include a period of time during which the print head experiences at least a selected temperature; and altering the voltage supplied to the transducer when the thermal aging period equals a first value.

2. The method of compensating for drop mass variation over time in an ink jet print head of claim 1, wherein the step of altering the voltage supplied to the transducer further includes the step of increasing the voltage.

3. The method of compensating for drop mass variation over time in an ink jet print head of claim 2, wherein the step of increasing the voltage supplied to the transducer further includes the step of increasing the voltage at a linear rate.

4. The method of compensating for drop mass variation over time in an ink jet print head of claim 3, wherein the step of increasing the voltage at a linear rate further comprises the step of increasing the voltage at a rate of between about 0.001 Volts/DAY and about 0.015 Volts/DAY, where DAY= $D_{PT}$, and $D_{PT}$=calendar days during which the print head experiences at least the selected temperature.

5. The method of compensating for drop mass variation over time in an ink jet print head of claim 4, further including the step of limiting the increase in voltage supplied to the transducer to a maximum differential voltage.

6. The method of compensating for drop mass variation over time in an ink jet print head of claim 5, further including the step of defining the maximum differential voltage as between about 2.0 Volts and about 4.0 Volts.

7. The method of compensating for drop mass variation over time in an ink jet print head of claim 6, further including the step of defining the selected temperature as at least about 135° C.

8. The method of compensating for drop mass variation over time in an ink jet print head of claim 7, wherein the first value is about 140 calendar days during which the print head experiences at least the selected temperature.

9. The method of compensating for drop mass variation over time in an ink jet print head of claim 4, wherein the thermal aging period is defined to include a period of time during which the print head experiences the selected temperature, a printer standby temperature and a jetstack standby temperature, and wherein the step of increasing the voltage at a rate of between about 0.001 Volts/DAY and about 0.015 Volts/DAY further includes the step of defining DAY as $DAY=DPT+[(D_{PS})*(F_{PS})]+[(D_{JS})*(FJS)]$, where $D_{PS}$=calendar days during which the print head experiences the printer standby temperature, $F_{PS}$=printer standby scale factor, $D_{JS}$=calendar days during which the print head experiences the jetstack standby temperature, and $F_{JS}$= jetstack standby scale factor.

10. The method of compensating for drop mass variation over time in an ink jet print head of claim 9, wherein the jetstack standby temperature is greater than the printer standby temperature.

11. The method of compensating for drop mass variation over time in an ink jet print head of claim 10, further including the step of limiting the increase in voltage supplied to the transducer to a maximum delta voltage.

12. The method of compensating for drop mass variation over time in an ink jet print head of claim 11, further including the step of defining the maximum delta voltage as between about 2.0 Volts and about 4.0 Volts.

13. The method of compensating for drop mass variation over time in an ink jet print head of claim 12, wherein the first value is about 140 calendar days during which the print head experiences the selected temperature, the printer standby temperature multiplied by FPS and the jetstack standby temperature multiplied by $F_{JS}$.

14. The method of compensating for drop mass variation over time in an ink jet print head of claim 13, further including the step of maintaining the print head at the jetstack standby temperature for at least one hour before adjusting the print head to the printer standby temperature.

15. The method of compensating for drop mass variation over time in an ink jet print head of claim 9, wherein $F_{PS}$ and $F_{JS}$ are each about 0.145.

16. The method of compensating for drop mass variation over time in an ink jet print head of claim 1, further including the step of saving the thermal aging period information in a non-volatile memory source.

17. The method of compensating for drop mass variation over time in an ink jet print head of claim 16, further including the step of updating the thermal aging period information in the non-volatile memory source at least every five minutes.

18. A printing system utilizing an ink jet print head that includes an ink jet for ejecting an ink drop having a drop mass, the drop mass of the ink drop varying over time, the print head utilizing a transducer to eject the ink drop, the transducer being actuated by a first voltage, the printing system comprising in combination:

a memory source that stores a total time during which the print head experiences a plurality of temperatures; and a controller that calculates a thermal aging period for the print head, wherein the thermal aging period is defined as a period of time during which the print head experiences at least a selected temperature, the controller adjusting the first voltage to at least a second voltage when the thermal aging period equals a first value.

* * * * *